US007069925B2

(12) United States Patent
Henry et al.

(10) Patent No.: US 7,069,925 B2
(45) Date of Patent: Jul. 4, 2006

(54) PRESSURE RELIEF SYSTEM FOR A GAS FIREPLACE

(76) Inventors: Daniel S. Henry, 1662 Highway 25 S., Kettle Falls, WA (US) 99141; Jack J. Wells, 2075 C. Johnson Rd., Rice, WA (US) 99167

( * ) Notice: Subject to any disclaimer, the term of this patent is extended or adjusted under 35 U.S.C. 154(b) by 33 days.

(21) Appl. No.: 10/384,376

(22) Filed: Mar. 6, 2003

(65) Prior Publication Data

US 2004/0173203 A1 Sep. 9, 2004

(51) Int. Cl.
*F24C 3/02* (2006.01)
*F24C 3/12* (2006.01)

(52) U.S. Cl. ..... 126/512; 126/307 R; 126/85 B

(58) Field of Classification Search ..... 126/307 A, 126/512, 307 R, 85 B; 110/173 B, 147, 110/263
See application file for complete search history.

(56) References Cited

U.S. PATENT DOCUMENTS 927,240 A * 7/1909 Hoffman ..... 292/78
1,101,094 A * 6/1914 Reiber ..... 110/173 B
1,588,789 A * 6/1926 Werner ..... 110/349
1,708,310 A * 4/1929 Korngiebel ..... 236/45
2,085,369 A * 6/1937 Kilborn ..... 473/610
2,158,030 A * 5/1939 Latulippe ..... 181/268
2,295,223 A * 9/1942 Le Clereq ..... 429/77
2,816,714 A * 12/1957 Worley ..... 237/53
5,309,891 A * 5/1994 Savoie ..... 126/85 B
5,398,669 A * 3/1995 McCullough et al. ..... 126/512
5,613,487 A 3/1997 Hawkinson
6,138,667 A * 10/2000 Cakebread ..... 126/512

FOREIGN PATENT DOCUMENTS

GB 1434530 * 5/1976
GB 2090959 * 7/1982

* cited by examiner

*Primary Examiner*—Carl D. Price
(74) *Attorney, Agent, or Firm*—Faegre & Benson, LLP

(57) ABSTRACT

A pressure relief system for a gas fireplace. The pressure relief system has a flue pipe with an opening in its side. A pressure relief plate is coupled to the flue pipe so that it is movable between an open and a closed state. The pressure relief plate positioned so that it covers the opening in the side of the flue pipe when the pressure relief plate is in the closed state. In the event of a gas explosion, the pressure relief plate is moved to an open state and the pressure build-up in the fireplace is relieved.

18 Claims, 8 Drawing Sheets

PRESSURE RELIEF SYSTEM FOR A GAS FIREPLACE

FIELD OF THE INVENTION

The present invention relates to gas fireplaces. More particularly, the invention relates to an apparatus for providing pressure relief for gas fireplaces.

BACKGROUND OF THE INVENTION

Many devices combust material to create a flame. For example, a fireplace is an efficient method for providing warmth and creating the appeal of a fire. A gas fireplace combusts a gas, usually LP or natural gas or a mixture thereof, combined with air to create a gas flame.

Factory-built fireplace assemblies have long been available as both free-standing and wall recessed units. One popular form of a fireplace functions as a room heater and comprises a combustion chamber surrounded by an enclosure providing a passageway for circulating room air over the combustion chamber. Heated air may thereby be circulated into the room either by gravity or by use of a blower system. This type of fireplace is preferably fired with natural or LP gas and has ceramic or cement artificial logs simulating the appearance of a wood burning fireplace while offering the advantage of efficiently converting the natural or LP gas to room heat.

A common design of a gas-fired fireplace includes a combustion chamber that is fabricated as a sealed enclosure. Some of these sealed enclosures fireplaces are vented by a concentric pipe arrangement in which flue gases are exhausted through a central pipe while intake air is drawn into the combustion chamber through an annular space defined by an outer larger diameter pipe. Such a direct-vent fireplace construction has become popular because the cooling effect on the central exhaust pipe by the intake air allows the fireplace to be vented without costly masonry chimney construction.

In a standard design of the gas-fired fireplace, the combustion chamber is sealed at its front face by a glass panel. The glass panel serves to enclose the combustion chamber while allowing the fire to be viewed by the occupants of the room. However, a failure in the ignition system of the fireplace could cause excess accumulation of gas within the combustion chamber which, if ignited, could in turn cause a combustion chamber explosion. Such an explosion could pose a safety hazard to the room occupants if the glass fireplace front were to shatter. Accordingly, it is common in fireplace design to incorporate explosion relief panels in the top of the metal enclosure that forms the combustion chamber. These panels are essentially designed to blow out under the pressure of an explosion and relieve the combustion chamber pressure without breaking the glass front.

A disadvantage of present fireplace construction using explosion relief panels in the combustion chamber is that in the event the panels are blown out by an explosion, it is a very labor-intensive job to repair the fireplace. Particularly, in typical cases in which the fireplace is a wall-recessed unit, the entire fireplace must be disassembled and removed from the wall to gain access to the relief panels. Generally, another disadvantage of common fireplace construction is that the frontal glass panel is mechanically secured to the fireplace enclosure by screws and other hardware making it time consuming to gain access to the interior of the enclosure in the event that maintenance of the fireplace needs to be performed.

Another way that pressure relief has been provided is by using a spring latch mechanism to allow a forwardly facing glass panel to pivotably open to relieve the pressure in the chamber. This type of arrangement is discussed in detail in our U.S. Pat. No. 5,613,487, which is incorporated by reference herein. This system provides the pressure relief mechanism at the front of the fireplace. Additional safety measures, however, are always desired in order to increase the safety of existing and future fireplace systems.

Accordingly, it is desirable to provide a fireplace assembly with an improved safety response in the event of a gas explosion.

SUMMARY OF THE INVENTION

Generally, the present invention relates to a gas fireplace. More particularly, the invention relates to an apparatus for providing pressure relief for a gas fireplace.

In one aspect, the invention relates to a pressure relief system for a gas fireplace that includes a flue pipe that defines an opening, and a pressure relief plate coupled to the flue pipe. The pressure relief plate is movable between an open and a closed state. The pressure relief plate is positioned so that it covers the opening when the pressure relief plate is in the closed state.

In another aspect the invention relates to a pressure relief system for a gas fireplace that includes an inner flue pipe that defines an inner flue opening, and an outer flue pipe that defines an outer flue opening. An inner pressure relief plate is coupled to the inner flue pipe so that it is movable between an open and a closed state, and the inner pressure relief plate is positioned so that it covers the inner flue opening when the inner pressure relief plate is in the closed state. An outer pressure relief plate is coupled to the outer flue pipe so that it is movable between an open and a closed state, and the outer pressure relief plate is positioned so that it covers the outer flue opening when the outer pressure relief plate is in the closed state.

In another aspect, the invention relates to a gas fireplace pressure relief system that includes a fireplace. A burner disposed to combust a combustible gas and air mixture within a combustion chamber enclosure of the fireplace. A flue pipe coupled to the fireplace to exhaust combustion products. The flue pipe defines a pressure relief opening. A pressure relief plate coupled to the flue pipe so that it is movable between an open and a closed state, the pressure relief plate positioned so that it covers the pressure relief opening when the pressure relief plate is in the closed state.

The above summary of the present invention is not intended to describe each disclosed embodiment or every implementation of the present invention. Figures in the detailed description that follow more particularly exemplify embodiments of the invention. While certain embodiments will be illustrated and describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENTS

The invention is applicable to a gas fireplace. In particular, the invention is directed to an apparatus for improving the safety response in the event of a gas explosion. While the present invention is not so limited, an appreciation of the various aspects of the invention will be gained through a discussion of the examples provided below.

Embodiments of the present invention may be used in conjunction with any system or apparatus that ignites a combustible gas to generate a gas flame and includes a flue or exhaust pipe to vent gases. A non-exhaustive list of such devices may include fireplaces, grills, furnaces, stoves, appliances, etc. While the example embodiments of the present invention provided below are described in conjunction with an example fireplace, the present invention is equally applicable to other systems or apparatuses as discussed above.

As used herein, the term "coupled" means any structure or method that may be used to provide connectivity between two or more elements, which may or may not include a direct physical connection between the elements. The term "flue" is used herein to mean an exhaust pipe system that includes an exhaust pipe. This system may include, however, an intake air pipe coaxial to the exhaust pipe.

Throughout the specification and figures, where the same or similar elements are present in multiple embodiments of the present invention, those elements are referred to with numbers that are related to one another, but differ only in their first digits.

Figure 1A:
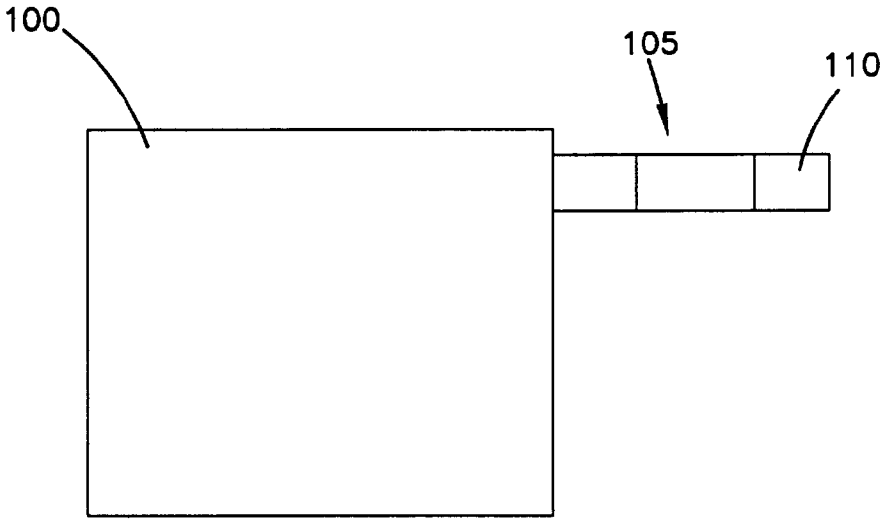
FIG. 1A is a schematic side view of an example embodiment of a fireplace with a pressure relief system in accordance with the present invention, where the pressure relief system is in a closed position.
Figure 1B:
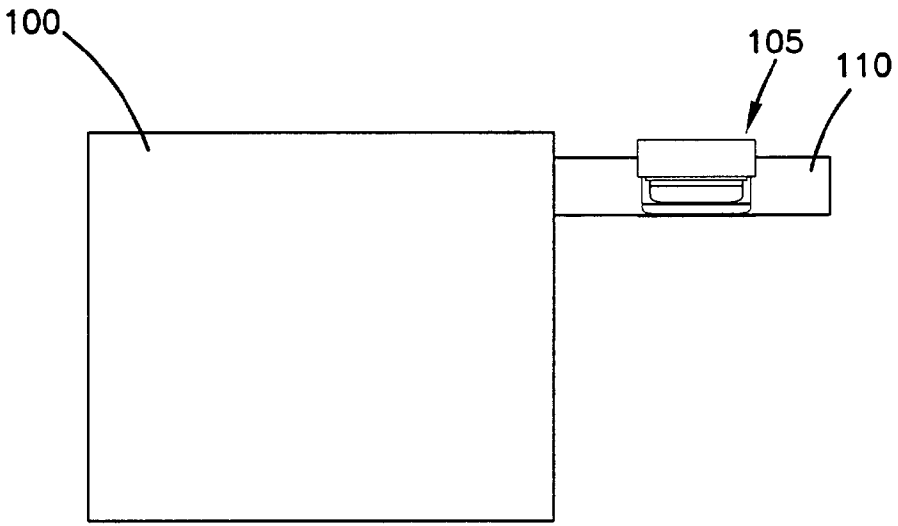
FIG. 1B is a schematic side view of the fireplace of FIG. 1A, where the pressure relief system is in an open position.

Referring now to FIGS. 1A and 1B, a side view of an example embodiment of a fireplace 100 is shown. The fireplace 100 includes a combustion chamber enclosure (not shown). The fireplace 100 generally functions to ignite combustible gas provided from a combustible gas source (not shown) to create a gas flame. A flue pipe 110, including a pressure relief system 105, is attached to the fireplace 100 to vent exhaust gases or combustion products from the fireplace 100. FIG. 1A shows the pressure relief system 105 in a closed position, and FIG. 1B shows the pressure relief system 105 in an open position. The pressure relief system 105 can be sized and positioned relative to the fireplace 100 to optimize pressure relief and to take into consideration space limitations.

Although the flue pipe shown in FIGS. 1A and 1B is horizontally arranged, the arrangement, shape, and configuration of the flue pipe can vary without affecting the application of the present invention. For example, the flue pipe could extend vertically or at an angle. Additionally, the flue pipe could extend vertically and then extend horizontally. Also, the flue pipe can be designed in any number of shapes. It could be cylindrical, rectangular, or any other desired shape.

Figure 1C:
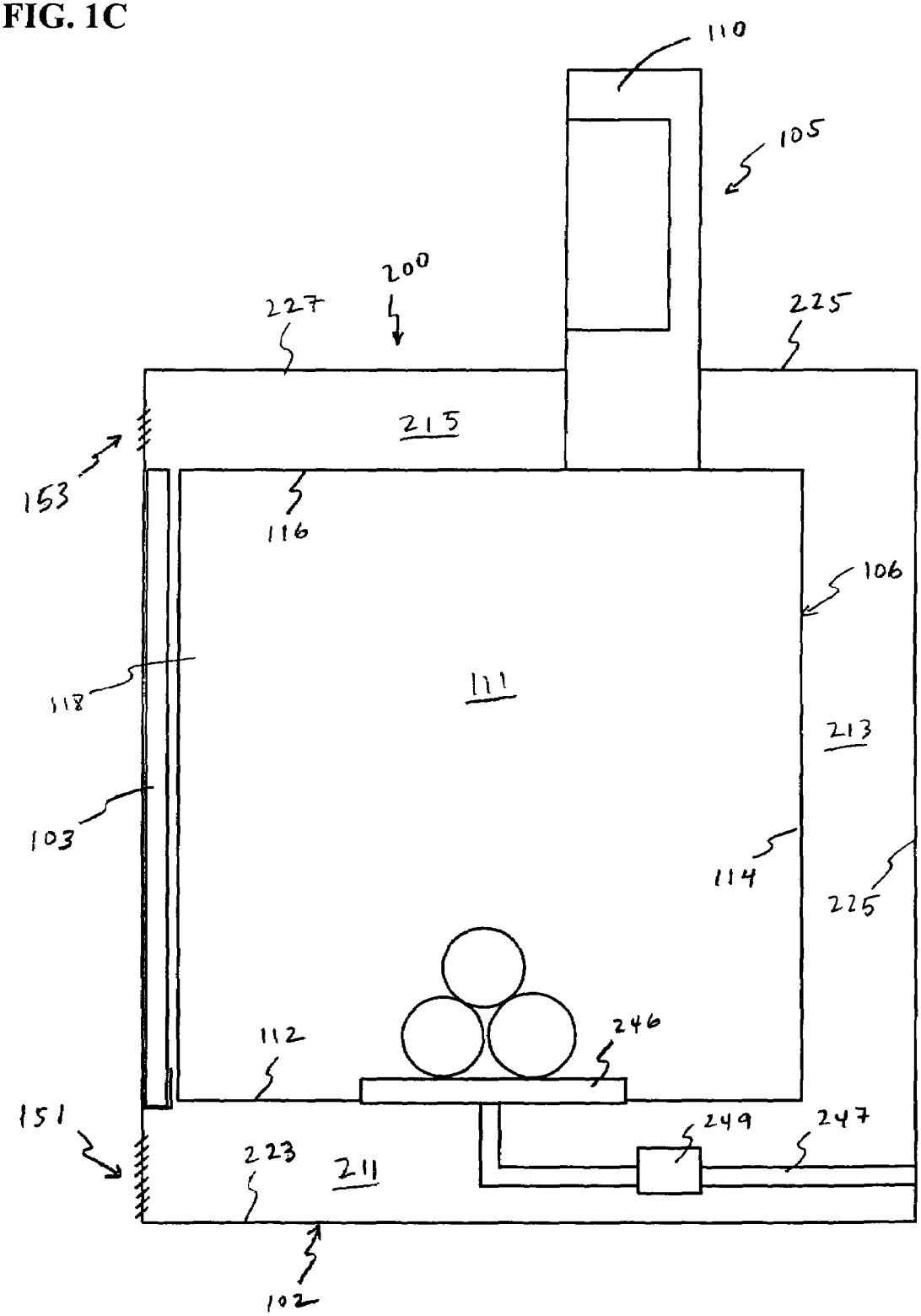
FIG. 1C is a schematic cross-sectional fire of a second embodiment of a fireplace with a pressure relief system in accordance with the present invention.

Referring to FIG. 1C, a schematic cross-sectional view of a second embodiment of a fireplace 200 is shown. Fireplace 200 is illustrated including an outer enclosure 102, a front panel 103, grills 151 and 153, and a combustion chamber enclosure 106. The combustion chamber enclosure 106 comprises front panel 103 and panels 112, 114, 116, and 118 that together with a second side panel (not shown) define a combustion chamber 111. The fireplace 200 may generally function to ignite combustible gas provided from a combustible gas source to create a gas flame. Alternatively, a simulated electric fireplace may be constructed within the outer enclosure 102. The simulated electric fireplace can include several electrical components such as a simulated ember bed, lights, fans, blowers, and motors.

Grills 151 and 153 cover a room air intake and room air exhaust, respectively. Fireplace 200 includes a lower plenum 211, a rear plenum 213, and a top plenum 215 positioned between outer panels 223, 225, and 227 and the combustion chamber enclosure 106. The plenums 211, 213, and 215 are fluidly connected to one another and define a plenum system through which room air may enter the lower plenum 211 through the grill 151, circulate through the rear and top plenums 213 and 215, and exit through the grill 153 back into the room. The room air may be heated as it travels through the plenum system. Optionally, a blower can be used for blowing room air through the plenums of the fireplace 200.

A burner 246 is shown positioned in the combustion chamber enclosure 106 to combust gas and thereby generate heat. Alternatively, the burner can be positioned so that its top surface is even with or position below panel 116. The burner 246 is coupled by a gas line 247 to a source of combustible gas (not shown). A gas valve 249 that can be opened and closed to regulate or modulate the flow of combustible gas and either turn the combustion within the fireplace 200 on or off can be couple to the gas line 247.

A flue pipe 110, including a pressure relief system 105, is attached to the fireplace 200 to vertically vent exhaust gases from the fireplace 200. The fireplace 200 and pressure relief system 105 are combined to form a gas fireplace pressure relief system. FIG. 1C shows the pressure relief system 105 in a closed position. However, if pressure, due to, for example, an explosion related to delayed ignition, occurs with sufficient force within the combustion chamber 106 of fireplace 200, the pressure relief system 105 would move to an open position.

The fireplace of the present invention can be any type of gas fireplace. For example, the present invention may be applicable to any prefabricated gas fireplace such as a direct vent, a universal vent, a B-vent, a horizontal/vertical-vent, a dual direct vent, a multisided unit, or other gas fireplace or insert. The present invention may also be applicable to other combustible gas burner systems other than a fireplace, as noted above.

Referring now to FIGS. 2A, 2B, 3A, and 3B, a first embodiment of a pressure relief system 105 of the present invention is shown. The pressure relief system 105 includes an inner flue pipe 120 and an outer flue pipe 130 that can be used with, for example, a direct vent fireplace. The inner flue pipe 120 exhausts combusted gases out of the fireplace through space 121. The outer flue pipe 130 acts as a flue for intake air that pass between the outer flue pipe 130 and inner flue pipe 120 within space 131.

An inner pressure (flue) relief plate 140 and an outer pressure (flue) relief plate 150 are coupled to the inner flue pipe 120 and outer flue pipe 130, respectively. Relief plates 140, 150 are coupled to flue pipes 120, 130 so that the relief plates 140, 150 are movable with respect to the flue pipes 120, 130.

Figure 3B:
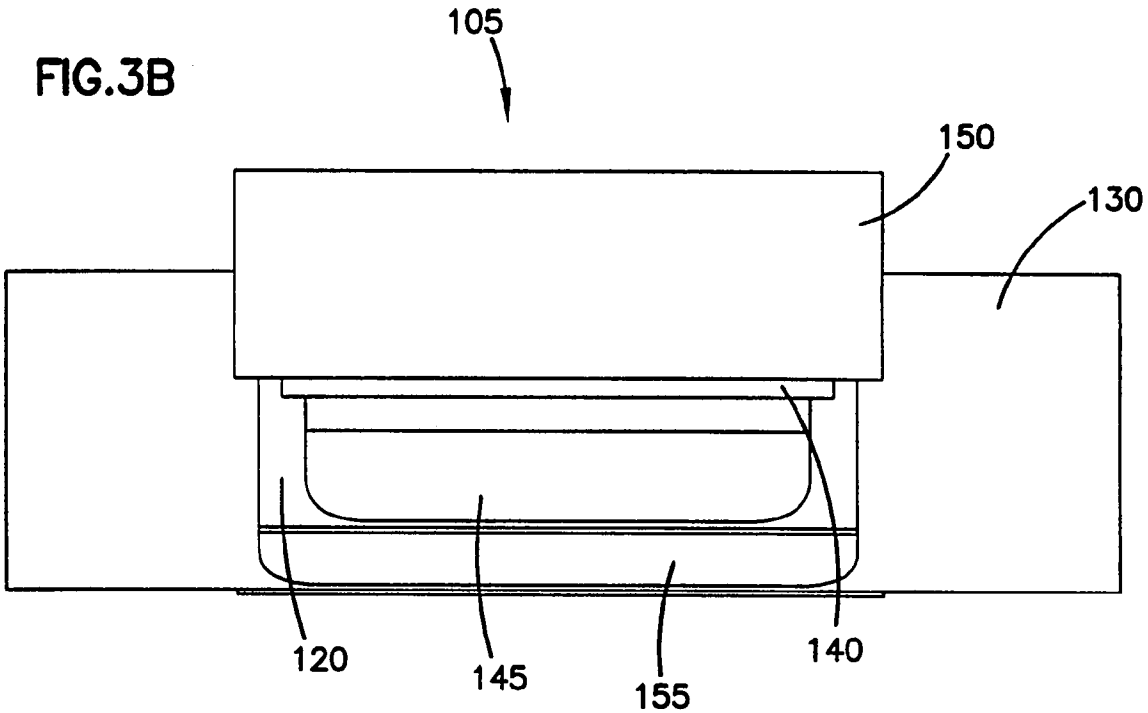
FIG. 3B provides a schematic side view of the example embodiment of the pressure relief system of FIG. 3A.

The inner flue pipe 120 and the outer flue pipe 130 both define pressure relief openings 145, 155 underneath the location of the pressure relief plates 140, 150. The inner flue opening 145 is defined by inner flue pipe 120, and the outer flue opening 155 is defined by outer flue pipe 130. In a closed position (state), an inner pressure relief plate 140 covers the inner flue opening 145 and an outer pressure relief plate 150 covers the outer flue opening 155. The opening 155 of the outer flue pipe 130 is preferably larger than the opening 145 of the inner relief pipe 120. This allows the pressure relief plate 140 of the inner flue pipe 120 to swing through the opening 155 in the outer flue pipe 130, when its pressure relief plate 140 opens as shown in FIG. 3B.

Figure 2B:
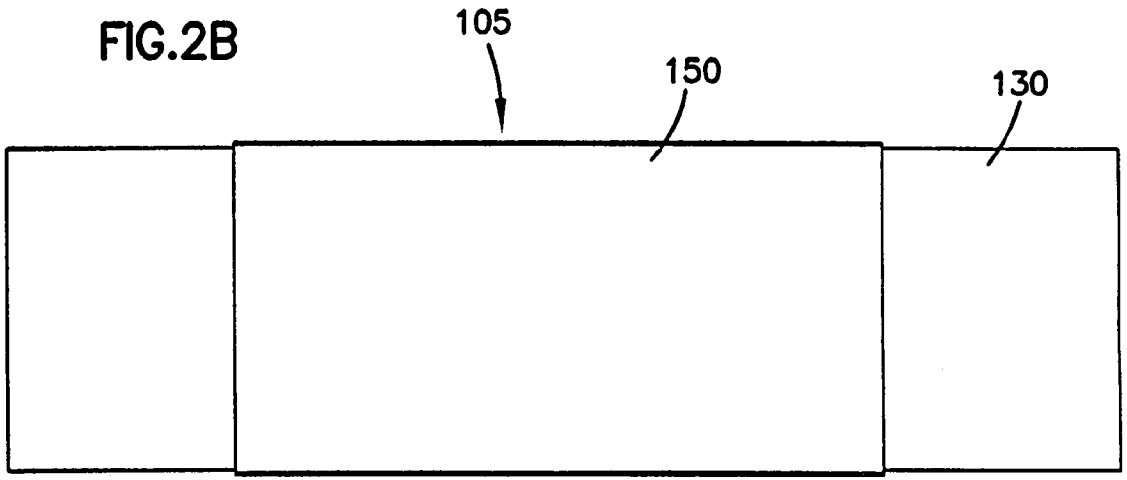
FIG. 2B provides a schematic side view of the example embodiment of a pressure relief system of FIG. 2A.
Figure 2A:
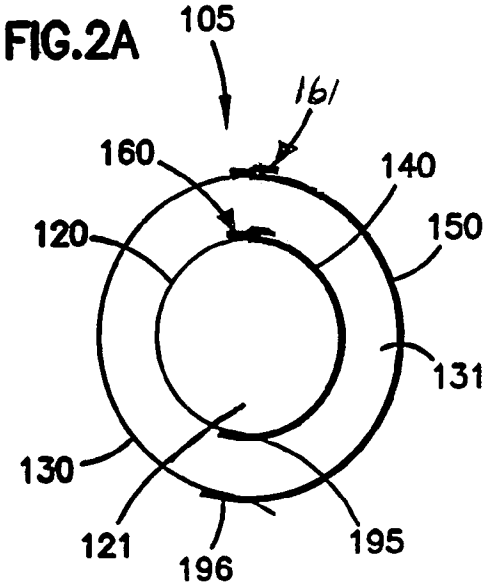
FIG. 2A provides a schematic end view of an example embodiment of a pressure relief system of the present invention, where the pressure relief system is in a closed position.
Figure 3A:
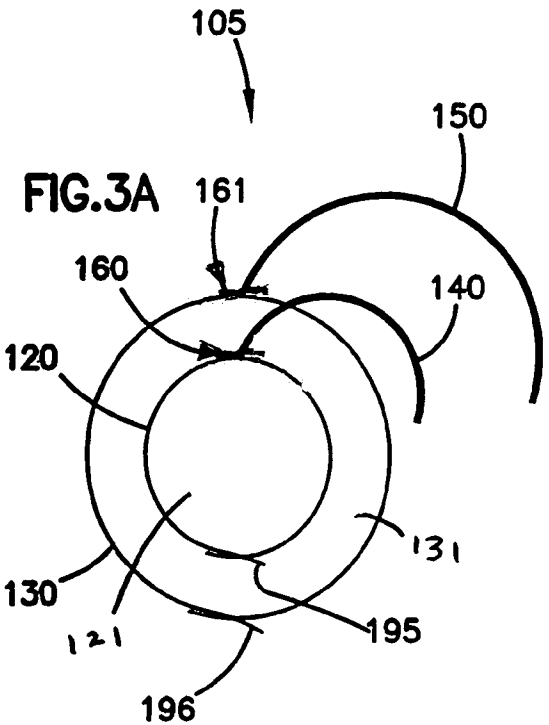
FIG. 3A provides a schematic end view of the example embodiment of the pressure relief system of FIGS. 2A and 2B, where the pressure relief system is in an open position.

FIGS. 2A and 2B show the relief plates 140, 150 in a closed position (state). Under normal operating conditions, the relief plates 140, 150 will remain in this closed position. However, if pressure, due to, for example, an explosion, with sufficient force occurs within fireplace, for example, within the combustion chamber 106 of fireplace 200, the relief plates are moved into an open position (state), as shown in FIGS. 3A and 3B. The excess pressure is then released out the pressure relief openings 145, 155.

In one embodiment, greater excess pressure can occur in space 121 than in space 131. The excess pressure in space 121 causes the inner pressure relief plate 140 to open first releasing some of the excess pressure out inner flue opening 145 into space 131. As the inner pressure relief plate 140 opens and pressure increases in space 131, the outer pressure relief plate 150 can then open to release the excess pressure out the outer pressure relief opening 155. The opening of the inner pressure relief plate 140 can also contribute to the opening of the outer pressure relief plate 150 through direct physical contact of plate 140 on plate 150 during the opening process.

Alternatively, outer flue pipe 150 can be constructed without a pressure relief plate and pressure relief opening. In this configuration, excess pressure in space 121 opens the inner pressure relief plate 140 allowing the excess pressure to pass through inner pressure relief opening 145. The excess pressure is then relieved within space 131.

In FIGS. 2A and 3A, inner and outer hinges 160, 161 are used to form this movable coupling. Latches 195, 196 are optimally used to keep the relief plates 140, 150 in the closed position until a gas explosion occurs. Other methods of coupling the relief plates 140, 150 to the flue pipes 120, 130 could be used such as, for example, screws, bolts, welds or other attachment means.

Figure 4B:
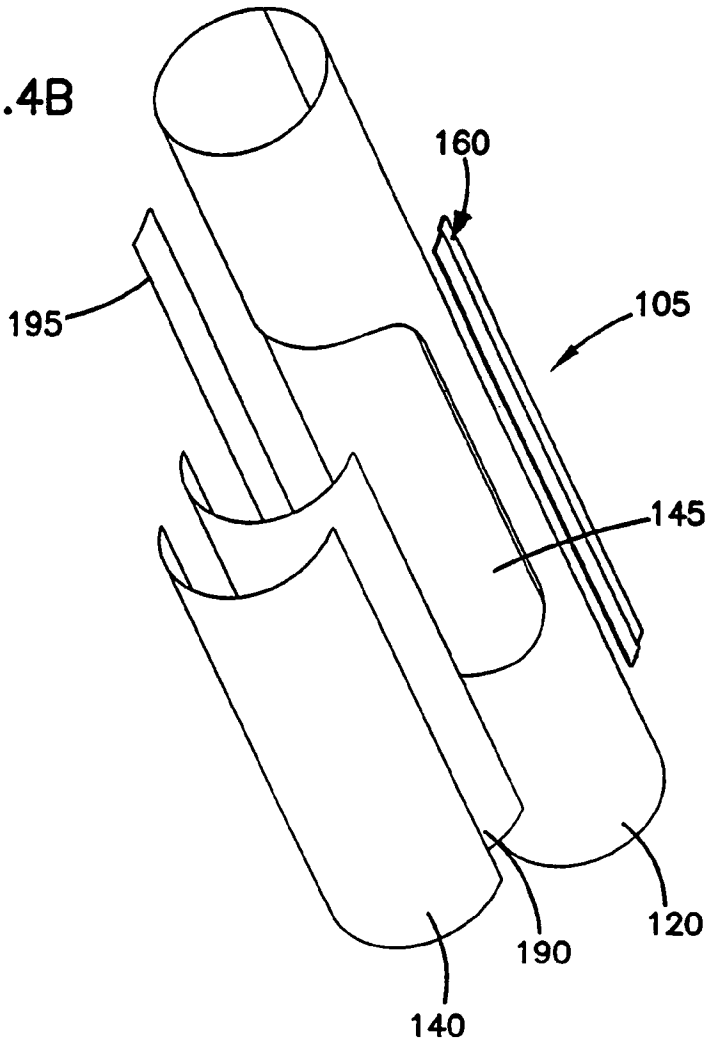
FIG. 4 shows an exploded perspective view of the pressure relief system of FIGS. 2A, 2B, 3A, and 3B.
Figure 4A:
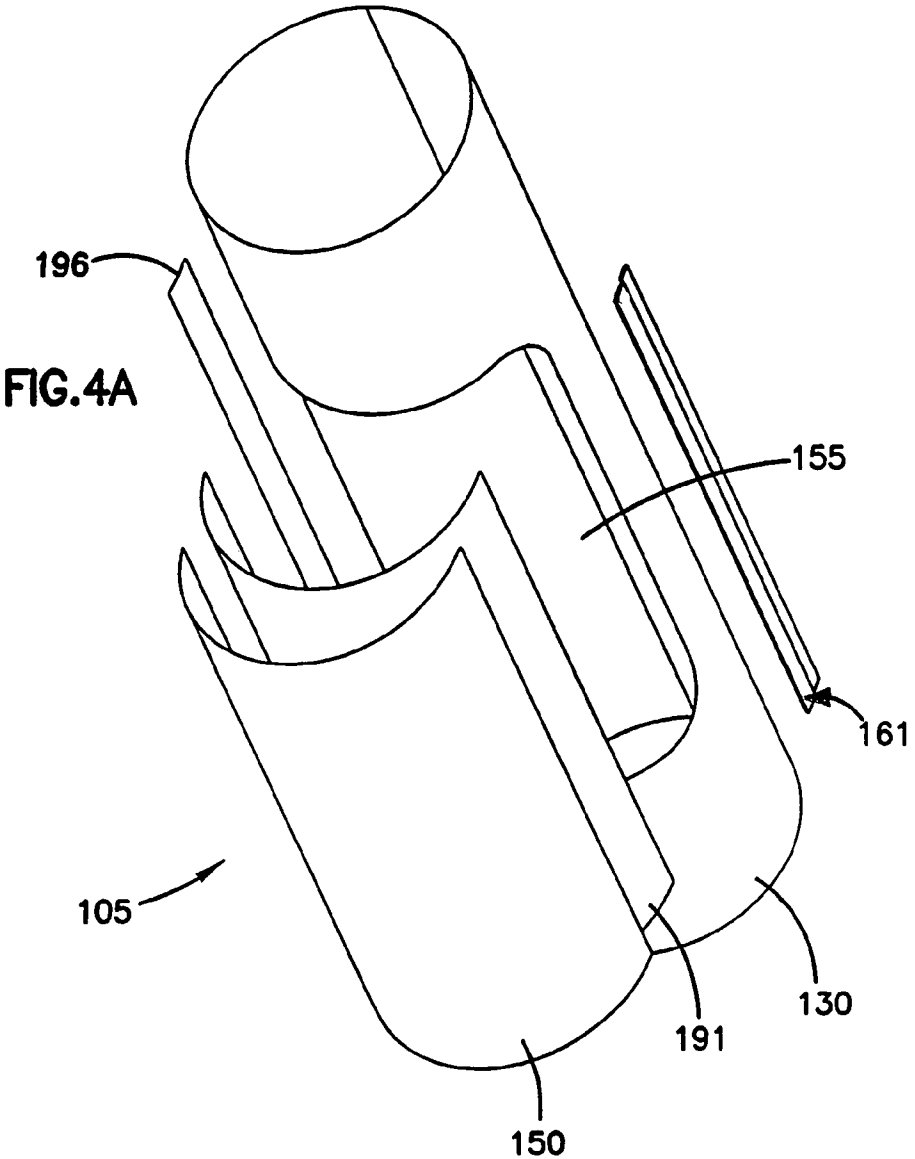

FIGS. 4A and 4B show a schematic exploded perspective views of the embodiment of FIGS. 2A, 2B, 3A, and 3B. The pressure relief plates 140, 150 are placed over inner and outer gaskets 190, 191. The gaskets 190, 191 can be formed of any number of materials that would effectively seal the pressure relief openings in the inner and outer flue pipes 120, 130 when the pressure relief plates 140, 150 are in the closed position. For example, the gasket 190 may be a ceramic paper. The ceramic paper can be attached to the pressure relief plates 140, 150 by, for example, a high temperature adhesive.

As discussed above, FIGS. 2A, 2B, 3A, 3B, 4A, and 4B show an inner and an outer flue pipe. This exemplary arrangement is common in direct-vent fireplaces where the inner pipe is an intake air pipe and the outer pipe is an exhaust pipe.

Figure 5:
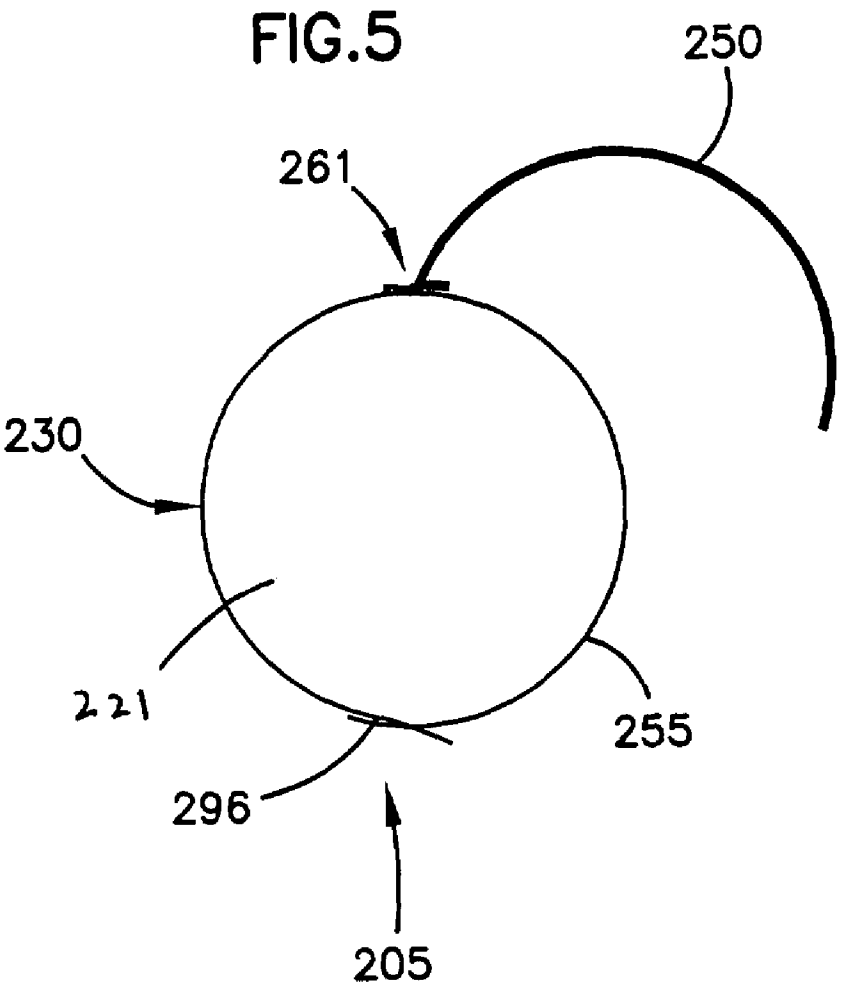
FIG. 5 is a schematic end view of a second embodiment of the pressure relief system of the present invention without an inner pipe.

The present invention is not constrained to the arrangement of FIGS. 2A, 2B, 3A, 3B, 4A, and 4B. Referring to FIG. 5, a second embodiment of a pressure relief system 205 is shown. In this embodiment, the flue pipe simply consists of a single pipe 230 or flue through which exhaust is moved out of a fireplace unit through a space 221.

This embodiment is applicable to fireplaces that, for example, have separate pipes that provide intake air and exhaust air to and from the fireplace unit or those that draw intake air from the room and only have an exhaust pipe. Also, any type of gas operated stove, fireplace, or other appliance that is provided with an exhaust air pipe, regardless or whether it has an intake air pipe, can use the pressure relief system 205 shown in FIG. 5. A pressure relief opening 255 is defined by flue pipe 230. The pressure relief plate 250 is movably coupled to the pipe 230.

Under normal operating conditions, the relief plate 250 remains in the closed position (state). However, if pressure, such as an explosion with sufficient force occurs within the fireplace, the relief plate moves into an open position (state). The open state is shown in FIG. 5. The excess pressure is then released out pressure relief opening 255. A hinge 261 is optimally used to form this movable coupling. A latch 296 can be used to keep the relief plate 250 in the closed position until a gas explosion occurs. Other methods of coupling the relief plate 250 to the flue pipe 230 could be used such as, for example, screws, bolts, welds or other attachment means.

Figure 6:
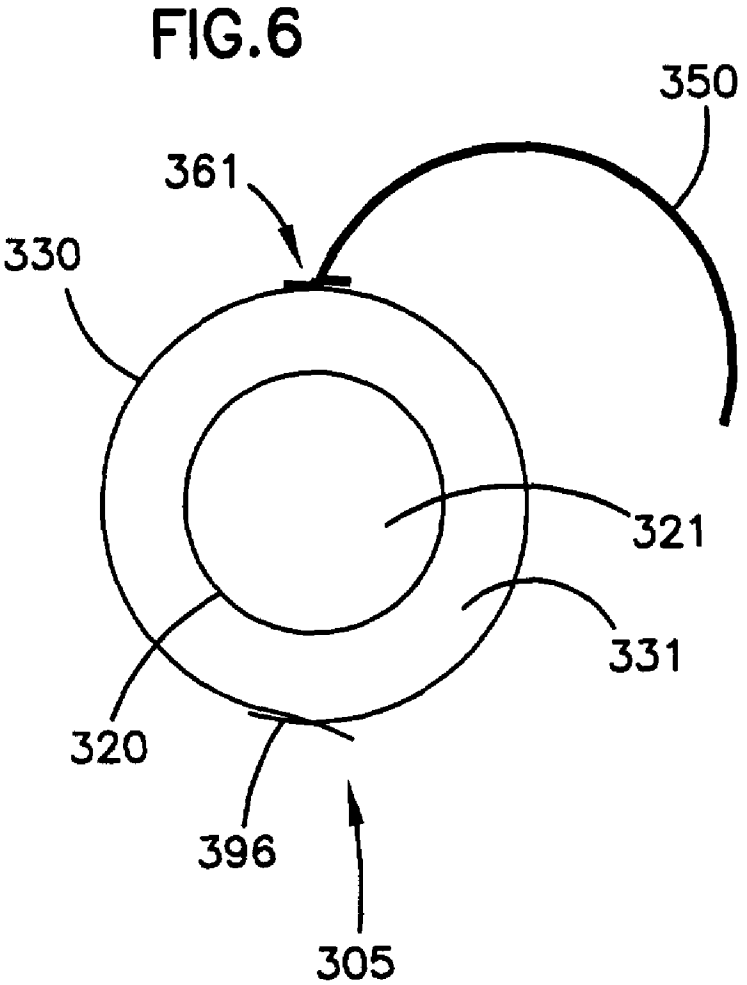
FIG. 6 is a schematic end view of a third embodiment of the pressure relief system of the present invention without a relief plate on an inner plate.

Referring to FIG. 6, a third embodiment of the present invention is shown. In this embodiment, the outer flue pipe 330 includes a pressure relief plate 350, while the inner flue pipe 320 does not contain a pressure relief plate. In this embodiment, the flue pipe may simply consist of a single pipe 330 or flue through which exhaust is moved out of a fireplace unit. This embodiment is applicable where, for example, the inner flue pipe 320 is an intake air pipe and the outer pipe 330 is an exhaust pipe. The inner flue pipe 320 brings intake air to the fireplace through space 321. The outer flue pipe 330 acts as a flue for exhaust gases that pass between the outer flue pipe 330 and inner flue pipe 320 within space 331. In some cases pressure build-up may occur in space 331 and not in space 321. Therefore, in some circumstances it may be unnecessary for the inner pipe 320 to have an opening in it for pressure relief. In this arrangement, the release of pressure from the exhaust pipe is sufficient to provide the degree of safety and effectiveness of the pressure relief system. Accordingly, the pressure relief plate 350 is coupled only to the flue pipe 330, which defines a flue pipe opening 355.

Under normal operating conditions, the relief plate 350 remains in the closed position (state). However, if an explosion with sufficient force occurs within the fireplace, the relief plate moves into an open position (state). The open state is shown in FIG. 6. A hinge 361 is optimally used to form this movable coupling. A latch 396 can be used to keep the relief plate 350 in the closed position until a gas explosion occurs. Other methods of coupling the relief plate 350 to the flue pipe 330 could be used such as, for example, screws, bolts, welds or other attachment means.

Figure 7A:
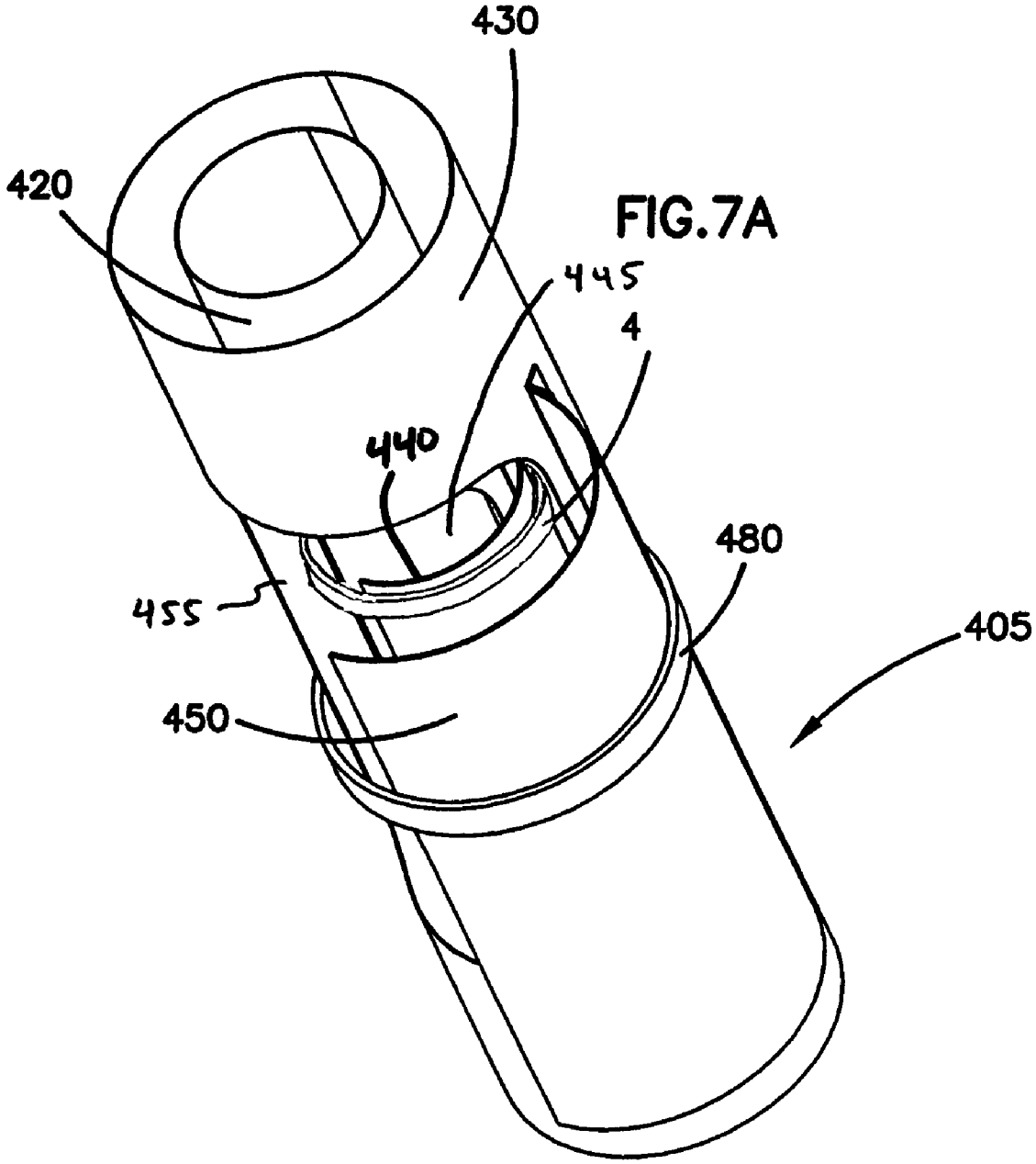
FIG. 7A shows a schematic perspective view of a fourth embodiment of the pressure relief system of the present invention, where the pressure relief system is in an open position.
Figure 7B:
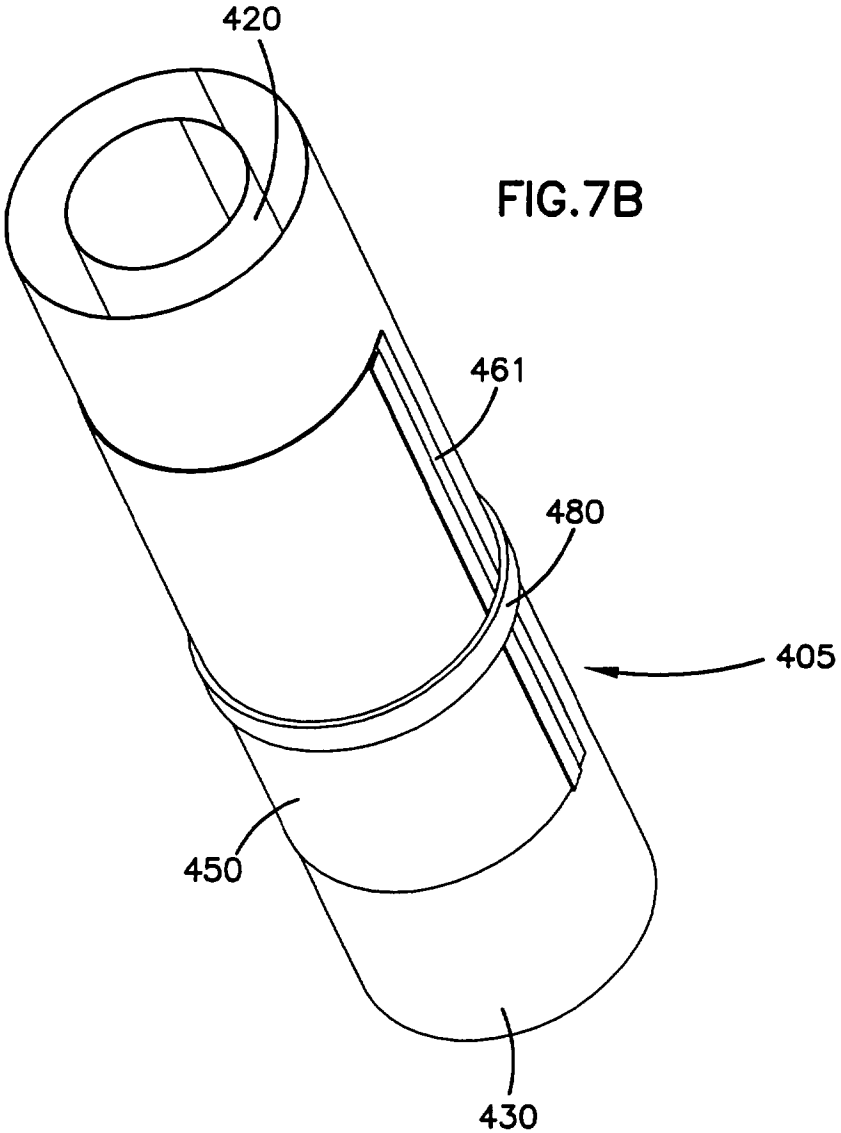
FIG. 7B shows a schematic perspective view of the fourth embodiment of the pressure relief system of FIG. 7A, where the pressure relief system is in a closed position.

Referring to FIGS. 7A and 7B, a fourth embodiment of a pressure relief system 405 of the present invention is shown. FIG. 7A shows the pressure relief plates 440, 450 in the open position and FIG. 4B shows the pressure relief plates 440, 450 in the closed position. Although not required, the pressure relief plates 440, 450 are preferably biased so that they will return to the closed position in the event that they are subjected to a gas explosion that causes them to temporarily open. The embodiment shown in FIG. 7 is identical to that shown in FIGS. 1–4 except that a biasing member 480 causes pressure relief plate 450, which has been opened by the occurrence of an event, such as a gas explosion, to return to a closed position. A second biasing member can be coupled to the inner flue pipe 420 to return the inner pressure relief plate 440 to a closed position.

A number of methods can be used to bias the pressure relief plates 440, 450 in this manner. For example, as shown in FIGS. 7A and 7B, an elastic band 480 can be attached to the outer flue pipe 430 to bias the outer pressure relief plate 450 to a closed position over outer pressure relief opening 455. A similar elastic band 481 can be used on the inner flue pipe 420 to bias the inner pressure relief plate 440 to a closed position over inner pressure relief opening 445. The elastic bands 480, 481 can preferably be made of an elastic material that is resistant to heat. If a sufficient pressure occurs, the pressure relief plates 440, 450 would press against the elastic bands 480, 481, thereby stretching the elastic bands 480, 481 and allowing the pressure to escape from the flue pipes 420, 430. Optionally, the bands 480, 481 can be constructed so that a threshold pressure must be reached within the flue before it moves to release the pressure.

Alternatively, any other biasing member, such as a spring wrapped around the flue pipe, could be used to serve this purpose. The biasing member can optionally be used with the embodiments shown in FIGS. 5 and 6. It may not be necessary to use a latch, such as that shown in previous embodiments, since the pressure relief plates are already biased in the closed position.

Existing fireplaces can be retrofitted with any of the pressure relief systems described herein without significant additional cost. The retrofit would simply involve replacing a section of the existing piping with the pressure relief system. Additionally, the pressure relief system is can be positioned behind the fireplace out of site of the user. The pressure relief systems can eliminate other relief mechanisms provided in the front, visible section of the fireplace. However, it may be desired to use the pressure relief system of the present invention along with other pressure relief measures, such as the relief panels inside the combustion box and/or the latch mechanism in the front of the fireplace, both of which are discussed in the background section of this application.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A pressure relief system comprising:

a first generally cylindrical pipe operably attached to a combustion chamber, the first pipe defining a pressure relief opening in a sidewall thereof;

a second generally cylindrical pipe disposed within the first pipe, the first and second pipes extending coaxially with each other, wherein one of the first and the second pipes exhausts gases produced in the combustion chamber and the other of the first and second pipes carries inlet air for the combustion chamber; and a pressure relief plate coupled to the first pipe so that the pressure relief plate is automatically movable between a closed and an open state upon the application of a sufficient pressure from within the first pipe, the pressure relief plate being positioned to cover the pressure relief opening when the pressure relief plate is in the closed state.

2. The system of claim 1, further comprising a hinge movably coupling the pressure relief plate to the first pipe.

3. The system of claim 1, further comprising a biasing member coupled to the pressure relief plate, the biasing member being configured such that the pressure relief plate returns to the closed state after an event occurs which moves the pressure relief plate into the open state.

4. The system of claim 3, wherein the biasing member is an elastic band that surrounds the flue pipe.

5. The system of claim 1, further comprising a gasket positioned between the pressure relief plate and the pressure relief opening.

6. The system of claim 5, wherein the gasket is a sheet of ceramic paper attached to the pressure relief plate.

7. The system of claim 1, wherein the pressure relief plate has a radius of curvature that substantially matches a radius of curvature of an outer surface of the first pipe.

8. The system of claim 1, wherein the pressure relief plate includes an elongate shape having a length that is greater than a width of the pressure relief plate, and the length is aligned parallel with a longitudinal axis of the first pipe.

9. A pressure relief system for a gas fireplace, the pressure relief system comprising:

an inner flue pipe, the inner flue pipe defining an inner flue opening in a sidewall thereof;

an outer flue pipe, the outer flue pipe defining an outer flue opening in a sidewall thereof, the inner flue pipe being positioned within and extending coaxially with the outer flue pipe;

an inner pressure relief plate coupled to the inner flue pipe so that it is movable between an open and a closed state, the inner pressure relief plate positioned so that it covers the inner flue opening when the inner pressure relief plate is in the closed state; and an outer pressure relief plate coupled to the outer flue pipe so that it is movable between an open and a closed state, the outer pressure relief plate positioned so that it covers the outer flue opening when the outer pressure relief plate is in the closed state.

10. The system of claim 9, wherein the inner and outer pressure relief plates are movably coupled to the inner and outer flue pipes with inner and outer hinges.

11. The system of claim 9, wherein the outer flue pipe is configured to allow the inner pressure relief plate to swing through the opening in the outer flue pipe when the inner and outer pressure relief plates are in the open position.

12. The system of claim 9, further comprising:

a first biasing member attached to the inner pressure relief plate, the first biasing member being configured such that the inner pressure relief plate returns to the closed state after an event occurs which moves the inner and outer pressure relief plates into the open state; and a second biasing member attached to the outer pressure relief plate, the second biasing member being configured such that the outer pressure relief plate returns to the closed state after an event occurs which moves the inner and outer pressure relief plates into the open state.

13. The system of claim 12, wherein the first biasing member and the second biasing member are elastic bands that surround the inner and outer flue pipes.

14. The system of claim 9, further comprising a first gasket positioned between the inner pressure relief plate and the inner flue opening, and a second gasket positioned between the outer pressure relief plate and the outer flue opening.

15. The system of claim 9, wherein the inner and outer pressure relief plates function independent of each other.

16. The system of claim 14, wherein the first gasket is comprised of a sheet of ceramic paper attached to the inner pressure relief plate and the second gasket is comprised of a sheet of ceramic paper attached to the outer pressure relief plate.

17. A gas fireplace pressure relief system, comprising:

a fireplace including an outer enclosure that defines an outermost surface of the fireplace, and a combustion chamber enclosure positioned within the outer enclosure;

a burner disposed to combust a combustible gas and air mixture within the combustion chamber enclosure;

a flue pipe coupled to the combustion chamber enclosure to exhaust combustion products, the flue pipe extending outside of the outer enclosure, the flue pipe defining a pressure relief opening in a portion of the flue pipe that is located outside of the outer enclosure;

a pressure relief plate coupled to the flue pipe so that the pressure relief plate is movable between an open and a closed state, the pressure relief plate being positioned to cover the pressure relief opening when the pressure relief plate is in the closed state.

18. The system of claim 17, wherein the pressure relief plate is positioned outside of the outer enclosure.

* * * * *

UNITED STATES PATENT AND TRADEMARK OFFICE

CERTIFICATE OF CORRECTION

PATENT NO. : 7,069,925 B2
APPLICATION NO. : 10/384376
DATED : July 4, 2006
INVENTOR(S) : Daniel S. Henry et al.

It is certified that error appears in the above-identified patent and that said Letters Patent is hereby corrected as shown below:

On title page Item [73] Assignee should read as follows:
HNI Technologies Inc.
Residence: Muscatine, Iowa Signed and Sealed this Second Day of October, 2007

JON W. DUDAS
*Director of the United States Patent and Trademark Office*